US005241927A

United States Patent [19]

Rhoads

[11] Patent Number: 5,241,927

[45] Date of Patent: Sep. 7, 1993

[54] INTERNAL COMBUSTION ENGINE WITH DIFFERENT EXHAUST AND INTAKE VALVE OPERATING CHARACTERISTICS

[76] Inventor: Eugene W. Rhoads, P.O. Box 2081, Julian, Calif. 92036

[21] Appl. No.: 963,986

[22] Filed: Oct. 20, 1992

[51] Int. Cl.[5] ..... F01L 1/34

[52] U.S. Cl. ..... 123/90.16; 123/90.57

[58] Field of Search ..... 123/90.15, 90.16, 90.48, 123/90.49, 90.5, 90.52, 90.55, 90.57

[56] References Cited

U.S. PATENT DOCUMENTS

| | | | |
|---|---|---|---|
| 3,403,663 | 10/1968 | Wagner | 123/90.16 |
| 3,742,921 | 7/1973 | Rendine | 123/90.16 |
| 3,921,609 | 11/1975 | Rhoads | 123/90.57 |
| 4,392,461 | 7/1983 | Rotondo | 123/90.16 |
| 4,524,731 | 6/1985 | Rhoads | 123/90.57 |
| 4,919,089 | 4/1990 | Fujiyoshi et al. | 123/90.16 |
| 4,930,465 | 6/1990 | Wakeman et al. | 123/90.16 |
| 4,977,867 | 12/1990 | Rhoads | 123/90.57 |
| 5,158,048 | 10/1992 | Robnett et al. | 123/90.16 |

FOREIGN PATENT DOCUMENTS

| | | | |
|---|---|---|---|
| 3026529 | 2/1982 | Fed. Rep. of Germany | 123/90.16 |

*Primary Examiner*—Willis R. Wolfe
*Assistant Examiner*—Weilun Lo
*Attorney, Agent, or Firm*—Marvin H. Kleinberg

[57] ABSTRACT

An internal combustion engine is provided with variable duration valve lifters on the exhaust valve train having response characteristics that are different from the valve lifters on the intake valve train. Either the intake valve train can be fitted with variable duration valve lifters having diminished or reduced bleed channel characteristics or stock valve (no bleed channel) lifters may be employed. In both events, the exhaust valves fitted with variable duration valve lifters with relatively greater bleed channel flow characteristics (as compared to intake valves) will open to a progressively greater degree in the mid range to high RPM engine speeds. The particular optimal engine functioning is achieved by precisely matching in a complementary fashion the appropriate degree of variable duration valve bleed flow channel size to the particular cam profile of the engine in use. By this means, better evacuation of exhaust gasses at mid to high engine speeds is achieved without adversely affecting engine performance at low speeds.

12 Claims, 4 Drawing Sheets

INTERNAL COMBUSTION ENGINE WITH DIFFERENT EXHAUST AND INTAKE VALVE OPERATING CHARACTERISTICS

The present invention relates to internal combustion engines, and, more particularly, a method and apparatus for increasing the efficiency of internal combustion engines by providing different operating characteristics for the intake and exhaust valves thereof.

Major improvements in internal combustion engine valve functioning has greatly improved the power and efficiency of the high performance auto engine at high revolutions per minute ("RPMs").

The first major development was the introduction of radical or performance camshafts. The result was an improvement in the magnitude and duration of valve opening (both intake and exhaust).

The second major improvement in valve functioning was the introduction of variable duration valve lifters within the last two decades. Typical prior art valve lifters are disclosed, for example, in the patents to James E. Rhoads, U.S. Pat. Nos. 3,304,925; 3,921,609; the patents to Jack L. Rhoads, U.S. Pat. Nos. 4,524,731; 4,913,106; and 4,977,867; and the patents to Gary E. Rhoads, U.S. Pat. Nos. 4,601,268; 4,602,597; 4,656,976; and 4,741,298. These variable duration valve lifters have significantly improved engine efficiency and power.

There are, however, shortcomings in the operation of the modern engine that have not been addressed by these prior art improvements, important though they might be. According to the present invention, there is, what might be considered, a third major breakthrough in improved engine performance as a result of improved valve function.

It has been discovered through extensive research and multiple practical trials, that the internal combustion engine (including, but not limited to high performance automobile engines) can be significantly improved in terms of power output, efficiency and mechanical durability, (i.e. resistance to breakdown and failure) by properly balancing the volumes of intake and exhaust gases entering and exiting the combustion chamber.

A new and significantly improved method of properly balancing these gasses is achieved through the use of a unique and original method not previously utilized. Extensive research on high performance automobile engines has led to the discovery that excessive gas/air mixture intake into the combustion chamber and deficient exhaust exit of spent combustion gasses from the combustion chamber significantly limit engine performance.

Improvement of the evacuation of burned gasses from the combustion chamber has been the goal of engine builders and mechanical engineers for decades. It has been realized that the achievement of this goal could dramatically improve the efficiency and power of the internal combustion engine. One traditional, standard, labor intensive and tedious procedure to approach this goal has been to increase the size and the shape of the exhaust ports and to highly polish these ports through which exhaust gasses exit the combustion chamber.

Gas flow turbulence as it exits the exhaust port is thereby reduced and the exit velocity and volume of burned gasses is thereby increased. According to the present invention, a significant improvement in engine performance can be achieved as a result of a significant improvement in gas flow volume and velocity (volumetric flow into and out of the combustion chamber).

Heretofore mechanical engineers and other experts have tried to increase engine power and efficiency by introducing increased amounts of combustible gasses into the combustion chamber. Following conventional wisdom, more combustible gasses exploding in the combustion chamber should result in greater force generated to drive the piston. Efforts have been geared in this direction—put more fuel into the combustion chamber so the power applied to the piston is increased.

However, the present invention and method, practically speaking, contradicts the universally held notion that more fuel introduced into the combustion chamber will result in more power. Consideration of the volumetric flow of gasses into and out of the combustion chamber can raise critical issues that outweigh the traditional notion that "more fuel means more engine power".

With the traditional approach, cramming increased combustible fuel into the chamber by various means does indeed result in increased forces of combustion (i.e. pressure generated within the chamber and increased driving force applied to the piston). However, a point of diminishing returns is quickly reached by this generally accepted approach.

As increased air-fuel volumes are burned in the combustion chamber, the piston is indeed driven with increased force; the problem that ensues as a consequence is that more spent, oxygen depleted gasses are thereby created, with a need for these greater volumes of exhaust gasses to be evacuated from the combustion chamber before fresh combustible gasses can re-enter the combustion chamber.

Forcing more combustible fuel into the combustion chamber creates the increased difficulties of larger volumes of gasses that must be removed or otherwise exit the combustion chamber. The traditional approach of increased fuel combustion, in essence, "chokes" the engine with excessive volumes of exhaust gasses that can't escape or exit from the combustion chamber fast enough.

This creates back pressure (also termed reverberation) which causes resistance to piston movement as it rises to push the large volume of exhaust gasses out of the exhaust ports of the combustion chamber. This increased back pressure is a force opposing piston movement, and thereby impedes, interferes with, or slows the piston's upstroke velocity. The end result is diminished engine RPM.

The high performance automobile engine, can be significantly improved in terms of output, efficiency and mechanical durability by properly balancing the volumes of the intake and exhaust gasses which enter and exit the combustion chamber.

Perhaps a simple example from medicine might help illustrate the problem. The medical illness termed bronchial asthma is a condition wherein restricted flow of air through the lungs of the individual causes respiratory distress, mechanical injury and damage to the lung tissue itself, and possibly even respiratory decomposition and death.

The problem in bronchial asthma is not the intake of air into the lung, but the exiting or expiration of air from the lungs. In this illness, intake is not restricted, but upon exhalation, the passageway through which air is carried (bronchials) constrict, causing restriction of airflow out of the lungs.

Thus an afflicted individual tries to compensate for his lack of respiratory exchange by breathing in (inspiring) more deeply and attempting to exhale more vigorously to force the air out of his lungs more rapidly. The passage of air out of the lungs however, is restricted because of the narrowing (bronchial spasm) of the exit passages.

As the individual bears down more strongly, back pressure is created within the lungs in the attempt to force air out of the lungs. The net effect is hyperinflation of the lungs and restricted exit of air from the lungs. The delay in emptying the lungs of its used air, and the prolonged expirations delay the onset of the next inspiration. Thus respiratory rate decreases as the patient struggles to intake more and more air. The wise doctor, under these circumstances, would advise the patient to not inspire as deeply, but rather, take limited, shallower inspiratory breaths, with the result that expiratory volumes will be reduced and more rapidly accomplished with reduced delay with respect to the onset of the next inspiration.

Ventilation can be increased by this method and respiratory compensation can be more readily maintained. This represents a fairly accurate analogy, to the case of the high performance automobile engine. Increased volumes of gas/air mixture are forced into the combustion chamber resulting in increased exhaust gasses created, which increases back pressure, as the piston rises in its exhaust stroke. This back pressure reduces or impedes the piston velocity on upstroke, and therefore RPM is compromised.

According to the "balanced graduated gas flow principle" of the present invention, variable duration roller valve lifters are installed only on the exhaust port valves. This is most effective in balancing the flow of gasses through the combustion chamber, given a particular camshaft configuration (i.e., approaching most radical). With a less radical cam configuration, the differential balance of gas intake to exhaust throughout the engines's RPM range might best be accomplished with, for example, variable duration valve lifters on intake with, perhaps ½ the bleed channel of the variable duration lifters on the exhaust valves.

In normal operation of the internal combustion engine, valves are opened and closed by means a camshaft. Lobes, which are the shaped protrusions on the cams that rotate on a shaft, move arms or rollers in translational motion as the camshaft rotates. The greater the outward protrusion of the lobe, the greater the magnitude of the translation and the greater the time duration and distance of the valve opening action.

Automotive mechanical engineers have significantly increased the power and efficiency of internal combustion automobile engines at high RPM (3,500 RPM and above) by increasing the size of the lobes or protrusions on the camshaft, and thereby increasing the valve opening in terms of both distance and duration. This modification in the size of the lobes of the cam is termed making the camshaft more "radical" in configuration, which is also termed making the cam a "performance cam".

The increased performance or power in the engine at high RPM is achieved by means of using a radical or performance cam to achieve an increase in valve opening (distance and time). At high RPM, gasses have less time to enter and exit the combustion chamber. By use of a radical or "performance" cam, the valves are opened relatively wider and longer which allows a maximum volume of gasses (both intake and exhaust) to enter and exit the combustion chamber. As mentioned, as the RPM increases, gasses have less time to enter and exit the combustion chamber.

Increasing the lobe size on the cam improves engine power and efficiency at higher RPM by increasing valve opening distance and opening duration. This allows a greater volume of gas to enter and exit the combustion chamber and thus improves the power of the engine. As engine RPM increases, the volume of gas entering and exiting the combustion chamber, or, the volume of gas that can or that does enter and exit the combustion chamber, is a critical factor in the power that the engine is able to generate.

The problem with a "performance" cam is decreased engine efficiency at low and mid-range RPM (3,500 RPM or less). This is the result primarily of what is termed "valve overlap" and back pressure. A discussion of these issues will follow.

Theoretically, prior to combustion the intake valve should open when the piston reaches top dead center, and should remain open until the piston reaches bottom dead center. Similarly, after combustion, the exhaust valve should open at bottom dead center and remain open until the piston reaches top dead center.

In the case of an engine fitted with a radical cam however, the intake and exhaust valves are held open longer than theoretically should be the case, as mentioned above. As such, the intake valves open before the piston is at top dead center, and the exhaust valves likewise open before the piston reaches bottom dead center.

The result is that both intake and exhaust valves are open simultaneously, producing a situation termed "valve overlap". At high RPM this valve overlap helps to give the engine a maximum volume of gas passage in and out of the combustion chamber in that phase of more rapid piston movement, when there is less time for gasses to enter and exit the combustion chamber. It has been found in practical reality that increased engine power results despite the fact that during combustion the intake and exhaust valves are simultaneously and to a variable degree (the magnitude of the overlap being directly proportional to the radical magnitude of the cam) still open.

Valve overlap, of course, allows gasses that are under very high pressure during combustion to escape out both the open intake and exhaust ports, thus reducing the driving force exerted on the piston. Theoretically this should reduce power and efficiency. At high RPM, however, despite this overlap, the increase in the ability of gasses to enter and exit the combustion chamber results in increased power.

The previous discussion has involved the issues relative to valve dynamics at high engine RPM. As stated, engine power and efficiency is significantly improved at high RPM with the use of radical or performance cam. The opposite however, is the case at low RPM. Engine power and efficiency are significantly reduced at low to moderate RPM (less than 3,500 RPM) in an engine with a performance or radical cam. This discussion is illustrating cam function only, and is exclusive of consideration of lifter function.

At low to moderate RPM, valve overlap occurs exactly as at high RPM. Once again, at high RPM keeping the valves open as wide and as long as possible improves the volume of gas flow into and out of the combustion chamber when filling and evacuation durations are at a minimum. At low to moderate (less than 3,500 RPM), large and long valve opening is not needed with respect to adequate filling and evacuation of gasses from the combustion chamber.

At low to mid RPM, during the precombustion and combustion phases when valve overlap occurs, relatively more time is available for exploding gasses to escape through the open valves. Because of valve overlap at low or moderate RPM the raw gas in the cylinder prior to combustion is not fully compressed by the piston and the poorly compressed raw gas therefore is poorly ignited or is not completely combusted, resulting in waste of fuel, poor power and efficiency and an engine that runs very "roughly".

It is for this reason that improvement in valve timing throughout the entire RPM range would offer very significant improvement in engine performance through its entire power range. To a degree, variable duration valve lifters (such as are shown in the prior art patents cited above) have improved the problem of valve overlap, and also to a degree have reduced the problem of reverberation or back pressure, as gasses exit through the exhaust ports.

All performance engines experience problems evacuating burned gasses after combustion. This problem has been a chronically vexing issue in increasing engine power and efficiency. Increased intake of raw unburned gasses into the combustion chamber has been greatly improved in the past by such means as fuel injection, turbos, blowers, etc., which has at the same time unfortunately exacerbated the problem of spent exhaust gasses.

As one increases the volume input of pre-combustion air/fuel mixture into the combustion chamber, a proportionally greater volume of exhaust gasses must exit that chamber after combustion. The greater volume of gasses needing to exit the combustion chamber has created a need for faster evacuation of these combusted gasses. As a large volume of combusted gas exits the exhaust port, turbulence of gas flow and back pressure (reverberation) limits the exit velocity and volume of this spent gas with, as mentioned previously, reduced velocity of piston movement.

Maximizing the movement of exhaust gasses out of exhaust ports has been facilitated by mechanical means such as increasing the size and shape of exhaust ports, as well as highly polishing these ports to improve flow and velocity of spent gasses. This is a highly labor intensive procedure which is both time consuming and quite costly.

The other means of facilitating evacuation of gasses from the combustion chamber is the use of custom exhaust pipes called "headers" and/or tuned headers, that are of streamlined profile to reduce back pressure of gasses that have exited the exhaust port and are now problematic in terms of back pressure build up in the exhaust pipes immediately distal to the exhaust port.

Variable duration lifters have also helped to facilitate the flow of intake and exhaust gasses. Traditionally, identical lifters (be they hydraulic, or variable duration in type) have been placed on both intake and exhaust ports. The rationale for this time honored practice has been habit and simple logic. This practice does not, however, adequately address the problems of the changing balance between intake and exhaust volumes that result as engine RPM changes.

Maximizing the flow of gas into and out of the combustion chamber is most important at high engine RPM range. The problems encountered to facilitate or maximize this gas flow at high RPM are distinct and unique to this spectrum or range of engine function, in contradistinction to the gas flow requirements at low engine RPM range.

At high RPM range valve overlap, despite its theoretical adverse (reduced) effect on combustion pressure, actually, in practical reality, results in improved engine performance (power and efficiency) by increasing or facilitating rapid gas volumetric flow through the combustion chamber. The relative importance or significance of facilitating increased gas flow dramatically increases as RPM increases (less time for filling and evacuation of the combustion chamber.)

At low RPM however, the relative importance of gas flow through the combustion chamber diminishes. Piston velocity is reduced and the time duration for filling and evacuating gasses from the combustion chamber is thereby prolonged. In this instance (i.e. low RPM) valve overlap with resultant increased or facilitated gas flow is not needed. There is "plenty" of time for filling and evacuation. Valve overlap (in high performance engines fitted with a radical cam) results in loss of combustion pressure at low RPM as gasses under high combustion pressure at ignition escapes out of the simultaneously open intake and exhaust ports, with the loss of engine power and efficiency as noted previously.

In practical reality and with experience over several years, problems have been observed with the traditional use of identical variable duration valve lifters that are placed on both intake and exhaust ports. Besides the issue of gas flow dynamics previously discussed, other problems such as excessive combustion pressures generated at high RPM, within the combustion chamber has resulted in damage to the valve train and head gaskets with broken pistons and rods and blown head gaskets and valve failure, and resultant premature destruction of the engine due to metal fatigue.

All of the above is the result of excessive intake of combustible gasses into the combustion chamber with excessive combustion forces developed therein as a result of "standard" variable duration valve lifters being placed on the intake ports. Identical "standard" variable duration valve lifters have been placed on intake and exhaust ports traditionally over the years with no attempt made to balance or adjust the gas flow dynamics with regard to cam profile or RPM.

Thus the universal practice has been as mentioned previously, the placement of identical acting variable duration valve lifters on intake and exhaust (i.e., identical oil bleed channels) producing poor balance between intake and exhaust valve openings and thereby restricting the maximization of gas volumetric velocity flow through the combustion chamber.

Designers are faced with a dilemma. How does one eliminate valve overlap at lower RPM ranges and thereby facilitate completed and efficient combustion of gasses and thereby maximize the piston driving force of combustion; yet, at higher RPM, gain valve overlap to facilitate or maximize gas flow without, at the same time, overdoing intake gas quantities leading to excessive combustion pressures, excessive volumes of combusted exhaust gasses thereby created that must be subsequently evacuated and excessive combustion force leading to mechanical breakdown and failure?

If one could obtain a properly balanced, gradually increasing flow of gas through the combustion chamber from low to high RPM, eliminating valve overlap at low RPM and eliminating excessive gas intake at low RPM, a better performing and more powerful engine throughout the entire RPM range with significantly reduced risk of engine breakdown and failure could be achieved.

According to the present invention, just such a result is achieved by means of the new concept of instituting variation in valve function between intake and exhaust proportional to RPM. Implementation is achieved by either eliminating variable duration valve lifters on intake, or the placement of unique variable duration valve lifters on intake (as contrasted to exhaust) with different response characteristics than the variable duration lifters that are placed in the exhaust valve train.

By "unique" is meant lifters with significantly reduced oil channel flow size (less bleed down), that are placed on intake ports as compared to lifters with relatively larger oil channel flow (more bleed down) that are placed on exhaust. One of the important results, among others, (outlined below) is significant reduction or elimination of valve overlap at low RPM with resultant significant improvement in engine power and efficiency at low RPM.

As a consequence, the above mentioned multiple problematic issues in engine power and efficiency throughout the entire RPM range could be very significantly alleviated. Proper balancing of intake and exhaust gasses as they travel through the combustion chamber results in increased power, increased performance, increased efficiency and durability of the high performance engine.

This proper balance is achieved by the proper differential adjustment in intake and exhaust valve functioning relative to one another throughout the RPM range relative to cam profile. It is standard practice for high performance engines to be fitted with a radical cam. In fact, radical cam and high performance engines are essentially synonymous terms.

Essentially all radical cams in production have relatively larger lobes for exhaust than for intake. Cam grinders (manufacturers of camshafts) have built cams in this configuration to produce valve overlap (best top end or high RPM performance) while, at the same time, facilitating increased exhaust valve lift (to improve evacuation of exhaust gases).

In terms of this, the optimal balance of gas intake and gas escape from the combustion chamber can be achieved by limiting or optimizing fuel intake and maximizing exhaust evacuation. Again, this can best be achieved by placement of variable duration valve lifters on the exhaust ports with relatively rapid bleed down effect, and either placing variable duration valve lifters on the intake ports with relatively little to no bleed in comparison to exhaust, or placement of no variable duration lifters on intake at all in cases where cam profiles dictate same.

This differential adjustment in functioning is the key concept that maximizes volumetric flow of gasses through the combustion chamber, i.e., optimizing intake and maximizing exhaust. This new idea or principle of intake vs. evacuation leads to a significant improvement in engine functioning and contradicts the current, commonly held idea of "more fuel, more power" principle. So, to repeat, the essential idea is that increased velocity and volume of the gasses passing through the combustion chamber can be achieved by the proper balancing of intake and exhaust valve function.

One can pump excessive amounts of gasses into the combustion chamber, and thereby increase combustion pressure to a degree, but the power or efficiency of the engine is compromised due to increased back pressure and/or reverberation difficulties and loss of power and efficiency at the lower RPM range due to valve overlap, a result that is oppositional to piston movement. In fact, it has been estimated that 30% to 50% of engine power and efficiency is lost at low to mid-range RPM due to back pressure (reverberation) effects and valve overlap effects.

By use of a variable duration roller valve lifter on exhaust, one can effectively reduce the valve lift at low to mid-range RPM by 20 to 30 percent and also effectively reduce the duration of the valve opening 20–30% on exhaust valves. With less valve lift at low RPM minimizing or eliminating valve overlap, the result will be more complete combustion. At higher RPM the variable duration roller valve lifter placed on the exhaust ports will pump up and increase or allow for increased volumetric flow of exhaust gasses that are able to exit the combustion chamber when it is most needed (little time for evacuation at high RPM).

Concomitantly, relatively narrower channel (less bleed) variable duration roller valve lifters can be placed on intake valves. The result will be relatively little change in intake valve opening at higher RPM. In practical reality, it has been observed that intake valves need not open significantly wider as RPM increases. Optimum increased fuel intake into the combustion chamber is in fact, achieved by means independent of increased intake valve opening.

There is no need to vary the widely increased intake valve opening at higher RPM. Higher intake can be achieved by other current technologies (blowers, turbos, higher volume carburetors, fuel injection, etc.). This virtually eliminates the need for variable valve lifters on intake in a significant number of high performance engines fitted with currently popular cam profile configurations. The wider channel, with resultant increased bleed on exhaust (as compared to intake) will keep the exhaust ports open wider and longer at higher RPM. This greatly facilitates the efficient venting of large volumes of exhaust gasses that are created at high RPM in the combustion process. (Recall, of course, that a given volume of entering pre-combustion fuel-air mixture produces exponentially greater volumes of post-combustion (exhaust) gas.)

It has been demonstrated that with more exhaust valve opening in relation to intake valve opening, the net effect is far more efficient and significantly increased flow of gasses with resultant increased engine power. The relatively greater opening of exhaust valves (compared to intake) makes sense on a logical basis as well. Much greater volumes of post combustion expanded or exploded gasses must gain exit compared to a much smaller precombustion's intake volume.) The end result is higher top end RPM and more rapid rate of increase in RPM from idle to top end RPM and increased power throughout the entire RPM range.

This principle can be termed the "balanced graduated gas flow principle", and refers to the proper balance between the flow of intake gasses relative to exhaust gasses throughout the entire RPM range (low, mid-range & high).

Accordingly, it is an object of the invention to provide a method of operating internal combustion engines more efficiently and with greater power by providing exhaust and intake valve trains with different operating characteristics at low and high RPM ranges.

It is an additional object of invention to provide an internal combustion engine with variable duration valve lifters on the exhaust valves but not the intake valves.

It is yet another object of invention to provide an internal combustion engine with variable lifters with first performance characteristics on the exhaust valves and with valve lifters having different performance characteristics on the intake valves.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

DETAILED DESCRIPTION OF THE DRAWINGS

Figure 1:
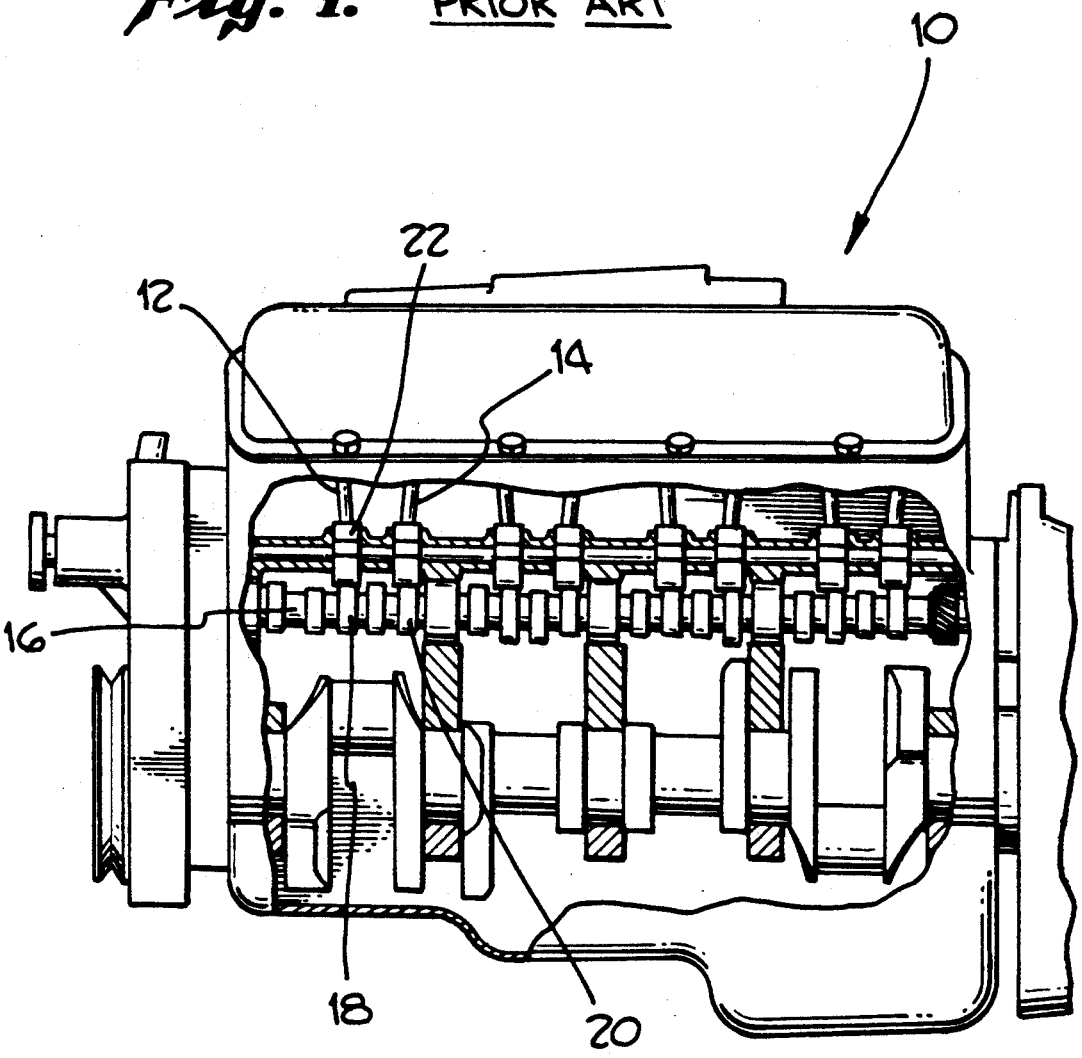
Fig. 1. PRIOR ART
FIG. 1 is a block diagram of an engine of the prior art with both intake and exhaust valve trains having the same performance characteristics.

Turning first to FIG. 1, there is shown a typical internal combustion engine 10 with an intake valve train 12 and exhaust valve train 14. A conventional cam shaft 16 includes individual intake cams 18 and exhaust cams 20 which have predetermined characteristics designed to affect the performance of the engine 10.

It is well known that certain goals can be achieved by appropriate design of the cams and many entrepreneurs have created successful businesses in designing and manufacturing cams with shapes that can improve performance of the engine in many ways including optimizing performance at low RPM 1500–2000), intermediate RPM (2000–3000) and at high RPM (3000 and above). A particular cam design may improve power, gasoline mileage or torque or any combination of these parameters and may optimize them for any particular speed range.

As noted above, variable duration valve lifters 22 can be included in the valve trains 12, 14 between the cams 18, 20 and the intake valves and exhaust valves. However, prior art internal combustion engines have been heretofore designed so that the intake valve train 12 and the exhaust valve train 14 have the same performance characteristics, whether or not variable duration valve lifters 22 are included in the trains 12, 14.

Figure 2:
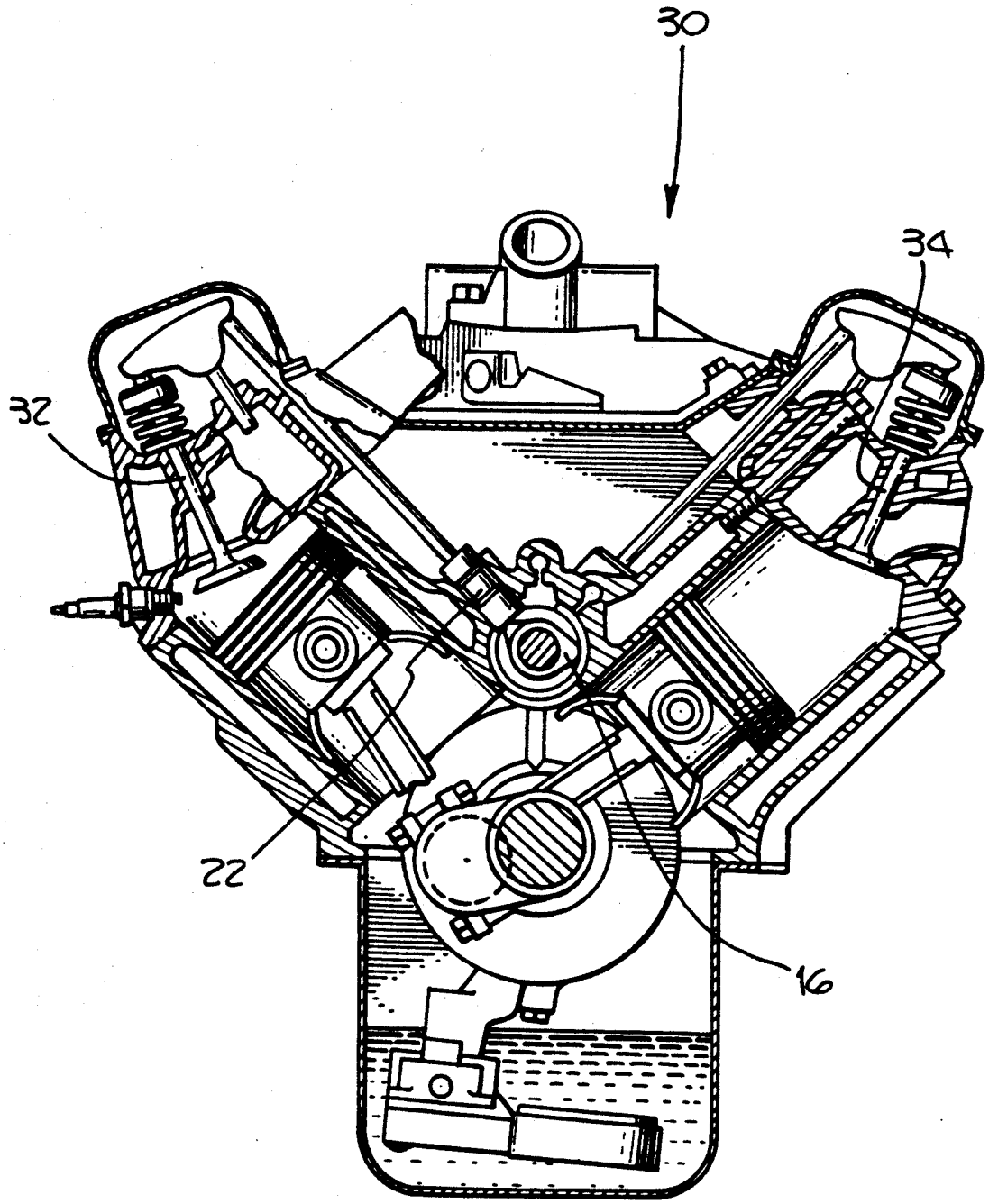
FIG. 2 is a block diagram of an engine utilizing variable duration lifters on exhaust valves only.

Turning next to FIG. 2, there is shown an engine 30 according to the present invention which can utilize the same intake and exhaust cams 18, 20 on the camshaft 16. However, according to the present invention, it is necessary that the operating characteristics of the intake valves 32 be different than the operating characteristics of the exhaust valves 34.

This is best accomplished by furnishing variable duration valve lifters 22 on the exhaust valves 34 and not on the intake valves 32. In the preferred embodiment, a typical prior art variable duration valve lifter 22, such as is shown in any of the above identified prior art patents can be provided with predetermined response characteristics which are selected by reference to the design of the exhaust cams and the performance desired from the engine.

For example, a variable duration valve lifter 22 may provide a longer exhaust valve operating time at higher RPM than at the low RPM range. The operating time becomes gradually less as the RPMs approach the "idling" range at which time the operating time is the briefest. This reduces valve overlap at the low RPM ranges so that the power produced by the combustion of fuel is maximized. In this range, the short operating duration of the exhaust valve is designed to be adequate to evacuate the exhaust gases from the cylinder.

Figure 3:
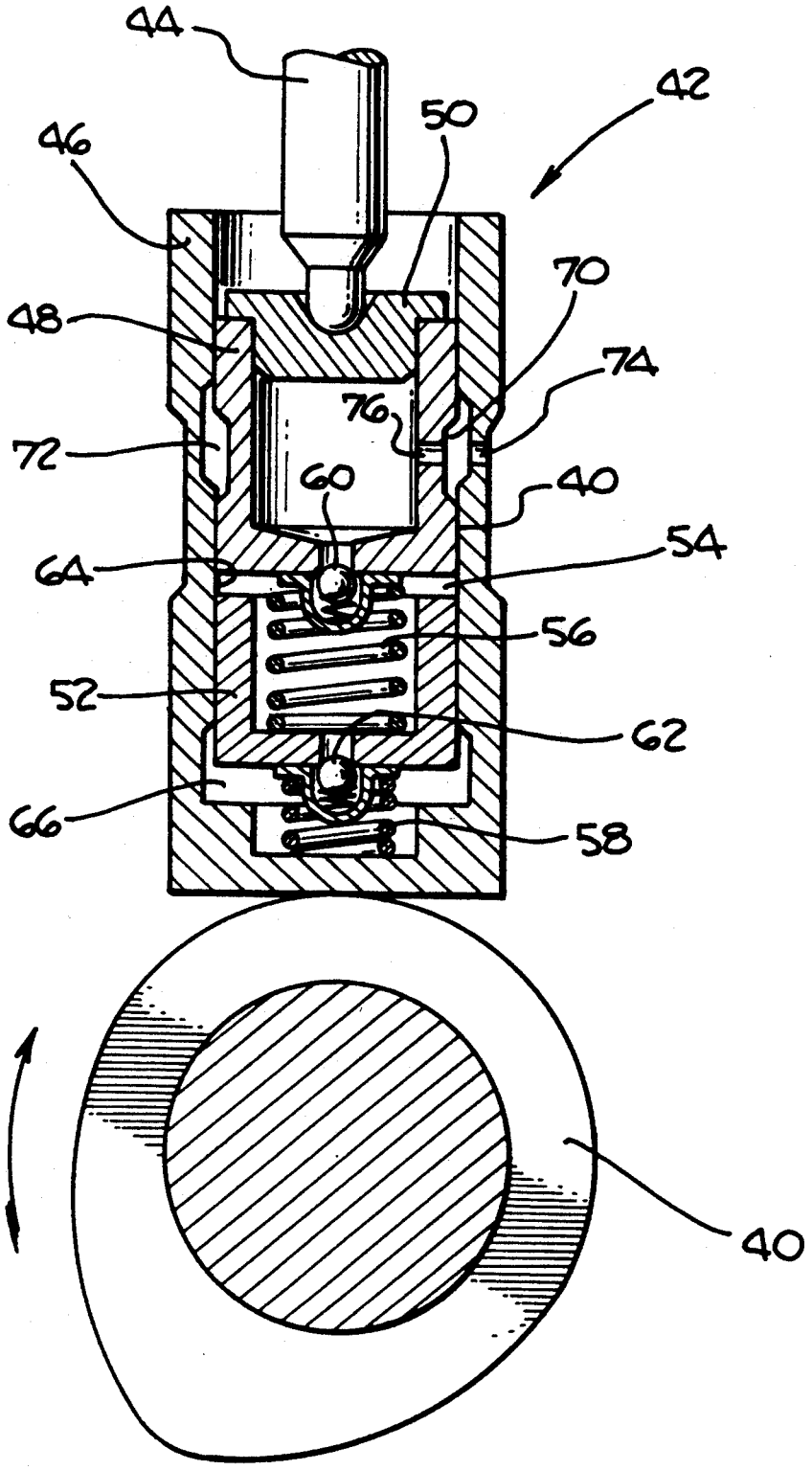
Fig. 3. PRIOR ART
FIG. 3 is a diagram of a typical prior art variable duration valve lifter.

Turning next to FIG. 3, there is shown a variable duration valve lifter of the prior art, suitable for use in the present invention. FIG. 3 is copied from U.S. Pat. No. 4,977,867 to Jack L. Rhoads, FIG. 1 and is typical of the self-adjusting variable duration hydraulic lifters currently in the market place. A cam 40 drives a hydraulic lifter 42 which, in turn, operates a rod 44 that controls the opening and closing of a valve in its seat. The lifter 42 has a cylindrical external body 46 with a cylindrical internal bore. An upper plunger 48 slides axially in the bore and supports the rod 44 on a cap 50.

The goal of the design is to have the upper plunger 48 sink down inside the lifter body 46 a predetermined amount and then sink no further, so that the termination of the sinking occurs during the opening stroke of the cam at low RPM. A second, lower internal plunger 52 is separated from the first upper plunger 48 by a gap 54 which is pre-established by the manufacturer, normally at about 0.030 inches. The size of the gap is controlled by the length of a spring 56 which is stronger than a second, lower spring 58. The upper spring 56 establishes the gap, but the second spring 58 maintains compression in the valve train and "pulls in" hydraulic fluid to maintain the valve train in constant proper adjustment.

Each of the plungers 48, 52 is fitted with a ball check valve 60, 62, respectively. These check valves 60, 62 could be replaced by other types of check valves and it is possible to eliminate the upper check valve 60 entirely, relying rather on a bleed passageway to refill the gap 54. A main oil chamber 64 beneath the upper plunger 48 receives oil to refill itself through the check valve 60 or through some other oil passageway. The lower chamber 66 has no exit other than whatever slight leakage might occur, so that there is a minimum flow of hydraulic fluid in and out of chamber 66.

The main oil chamber 64 communicates with the vehicle oil gallery through some kind of restricted bleed passageway such as a score on the check valve 60 preventing a tight seal, a very small hole in the bottom of the upper plunger 48, or by means of a slot or flat 70 that is milled or ground into the wall of the upper plunger 48 which communicates from the gap area inside the lifter to annular oil passage recesses 72 which communicate through an orifice 74 with the main oil gallery of the vehicle and an orifice 76 of the upper plunger 48.

As the lifter operates during the engine cycle, the valve is shut prior to the start of the lift cycle. The upper spring 56 expands the plungers 48, 52 to create a maximum gap 54. Under normal oil pressure, oil is forced in from the oil gallery through the orifices 74, 76 inside the upper plunger 48 and then down through the check valve 60 or, if so constructed, through a bypass, to fill both the main and lower oil chambers 64, 66. The valve train is thereby lengthened by the width of the gap 54.

As the cam 40 rotates, because the valve train has been lengthened, the valve opens early. At low RPM, however, there would be virtually no premature valve opening because the lifter operation is relatively slow and oil from the main oil chamber 64 would quickly leak out through the bleed passageway (slot or flat 70) and the upper plunger 48 would "bottom out" on the lower plunger 52 early in the cam cycle. As the engine speeds up, however, the time available to lose oil from the chamber 64 is shortened and the gap disappears later and later in the engine cycle until a speed is reached where insufficient oil has leaked and the valve train always appears to be lengthened to open the valve earlier in the cycle.

Figure 4:
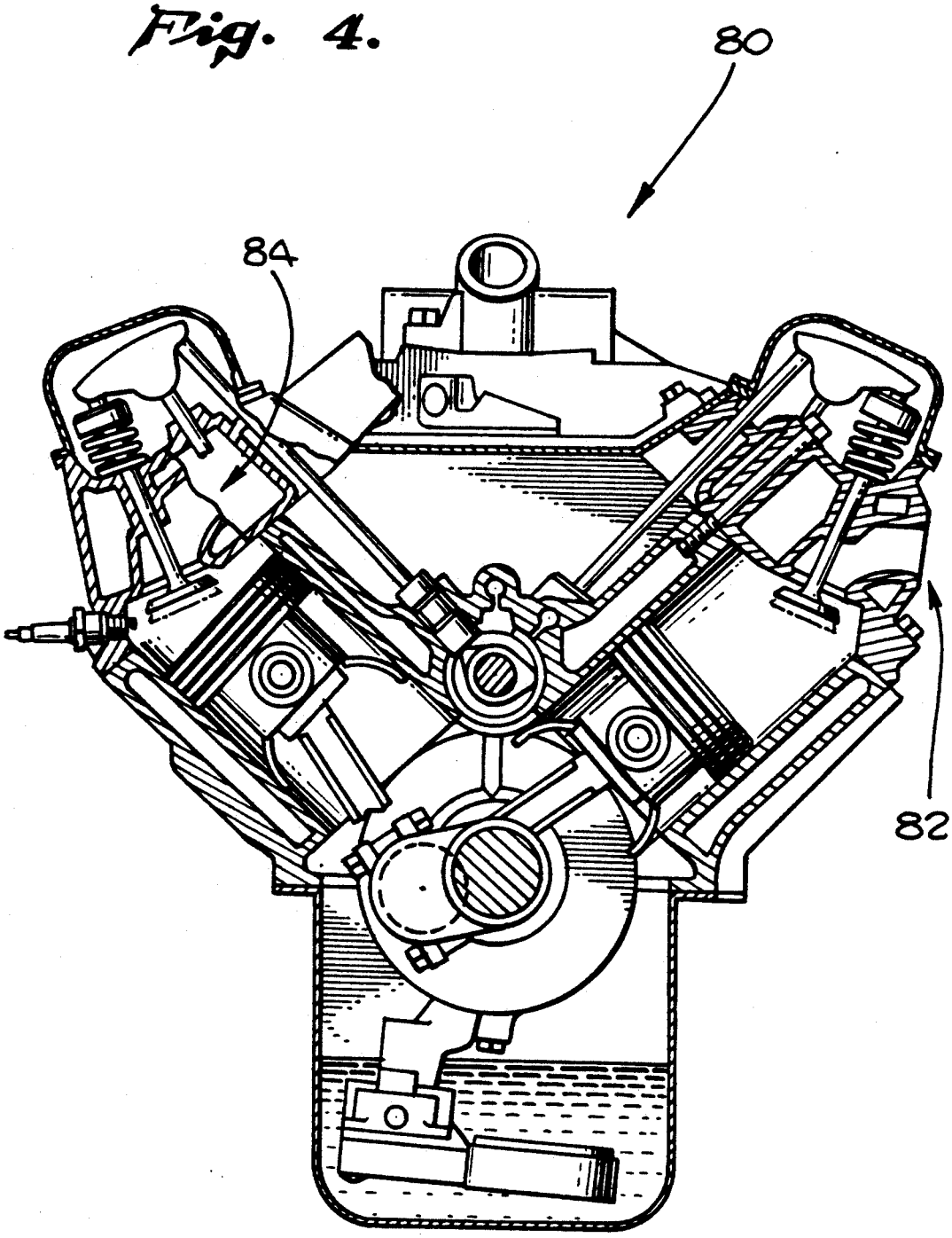
FIG. 4 is a block diagram of an engine according to the present invention in which the intake and exhaust valve trains have different performance characteristics.

Finally, with reference to FIG. 4, there is shown an engine 80 with variable duration lifters in the exhaust valve train 82 having a first operating characteristics. This can be a "fast" lifter which is variable at the lowest to mid range RPMs. The intake valve train 84, however, has variable duration valve lifters which are relatively "slow" and are variable only at the low RPM range and are fixed through the mid range to the high range, thereby maximizing valve operation at the mid and high RPM range.

In dynamometer testing of a new, internal combustion engine rated at 350 cu. in. displacement, a baseline test was run using a standard, factory supplied camshaft and valve train. The following results were obtained, uncorrected for ambient conditions:

| SPEED (RPM) | TORQUE (lb.ft.) | POWER (Hp) |
|---|---|---|
| 3500 | 326 | 217 |
| 4000 | 354 | 270 |
| 4500 | 348 | 298 |
| 5000 | 327 | 311 |
| 5500 | 303 | 318 |

A similar test was run over a wider range of speeds using a "high performance" cam with the following results, corrected for standard temperature and pressure:

| SPEED (RPM) | TORQUE (lb.ft.) | POWER (Hp) |
|---|---|---|
| 1500 | 277.0 | 79.1 |
| 2000 | 328.4 | 125.1 |
| 2500 | 323.4 | 153.9 |
| 3000 | 333.8 | 190.7 |
| 3500 | 343.1 | 228.6 |
| 4000 | 377.3 | 287.4 |
| 4500 | 379.9 | 325.5 |
| 5000 | 366.8 | 349.2 |
| 5500 | 338.9 | 354.9 |

Next, a set of tests was run using variable duration cam lifters with a 0.003 bleed-down channel on exhaust and with a 0.0025 bleed-down channel on intake, using the same camshaft, corrected for standard temperature and pressure with the following results:

| SPEED (RPM) | TORQUE (lb.ft.) | POWER (Hp) |
|---|---|---|
| 2000 | 347.8 | 132.4 |
| 2500 | 347.8 | 165.6 |
| 3000 | 350.4 | 200.2 |
| 3500 | 364.7 | 243.0 |
| 4000 | 386.0 | 294.0 |
| 4500 | 385.4 | 330.2 |
| 5000 | 368.0 | 350.3 |
| 5500 | 341.6 | 357.7 |
| 6000 | 309.2 | 353.2 |

Yet another test was run utilizing variable duration cam lifters only on exhaust, with 0.003 bleed-down channel. The following results were achieved, corrected for standard temperature and pressure:

| SPEED (RPM) | TORQUE (lb.ft.) | POWER (Hp) |
|---|---|---|
| 2000 | 345.0 | 131.4 |
| 2500 | 336.1 | 160.0 |
| 3000 | 347.7 | 198.6 |
| 3500 | 354.6 | 236.3 |
| 4000 | 376.9 | 287.1 |
| 4500 | 383.6 | 328.7 |
| 5000 | 369.6 | 351.9 |
| 5500 | 334.0 | 349.8 |

It can be seen from the above tables that there can be an improvement in both torque and horsepower, especially at the lower to middle RPM range. This is shown by the following tables:

| SPEED (RPM) | C-B | % IMP | D-B | % IMP |
|---|---|---|---|---|
| | TORQUE DIFFERENCE (ft. lbs.) | | | |
| 2000 | 19.4 | 6% | 16.6 | 5% |
| 2500 | 24.4 | 7% | 12.7 | 4% |
| 3000 | 16.6 | 5% | 13.9 | 4% |
| 3500 | 21.5 | 6% | 7.7 | 2% |
| 4000 | 8.7 | 2% | −0.4 | — |
| 4500 | 6.1 | 2% | 4.3 | 1% |
| 5000 | 1.2 | — | 2.8 | 1% |
| 5500 | 2.7 | 1% | −4.9 | −1% |
| | POWER DIFFERENCE (Hp) | | | |
| 2000 | 7.3 | 6% | 6.3 | 5% |
| 2500 | 11.7 | 8% | 6.1 | 4% |
| 3000 | 9.5 | 5% | 7.9 | 4% |
| 3500 | 14.4 | 6% | 7.7 | 3% |
| 4000 | 6.6 | 2% | −0.3 | — |
| 4500 | 4.7 | 1% | 3.2 | 1% |
| 5000 | 1.1 | — | 2.7 | 1% |
| 5500 | 2.8 | 1% | −5.1 | −1% |

As can be seen from the above tables, there is a measurable improvement primarily in the lower to middle RPM range when utilizing variable duration lifters on the exhaust valve train. The improvement is greatest when variable duration lifters in the exhaust train have a slower bleed-down than the lifters of the intake train. The improvement is measurable when variable duration lifters are utilized in the exhaust train, only.

The above results were achieved with a "stock" head that has not been designed for the most efficient venting of the intake and exhaust ports. For higher performance, heads are usually prepared by modifying the intake and exhaust ports through grinding and polishing to facilitate increased volumetric flow. It is believed that significantly improved results can be obtained when such specially prepared heads are utilized in the tests.

Accordingly, there has been shown a method and apparatus for achieving an improvement in the automobile engine by the proper balance of intake to exhaust gasses. By placing differentially channeled (and therefore differentially functioning) variable duration valve lifters on intake and exhaust ports, maximum power and efficiency throughout the entire RPM range of the engine can be thereby obtained.

By means of this change in the heretofore practical application of variable duration valve lifters, a significantly improved and efficiently running engine can be obtained at low to mid range RPM, together with a modest improvement of engine function at the higher RPM as well.

An engine functioning at low to mid range RPM is improved to the extent that efficient combustion of intake gasses can be obtained with sufficient and effective evacuation of these gasses such that the engine will run smoothly and efficiently without waste of fuel, and with an improved power output.

It can be demonstrated that performance at the top end RPM is improved and that increased acceleration of RPM is achieved, i.e., shorter time duration from idle to top end RPM. Engines with differentially functioning variable duration valve lifters on intake vs. exhaust ports can be provided and groups or sets of variable duration valve lifters that are selectively balanced and are functionally unique for placement on intake and exhaust valves.

This would also include the marketing of only one set of variable duration valve lifters for placement on exhaust ports when this configuration proves most advantageous with respect to the performance parameters considered most important. The lifter provides less valve opening at low RPM and greater valve opening at higher RPM as a function of its leaking oil (bleeding) through the channel (bleed channel).

At low RPM more oil can flow (bleed) out from under the "piston", thus resulting in less vertical lift of the piston without consequent decreased valve opening. At high RPM the oil beneath the piston is compressed almost instantaneously by the very rapid lift of the valve roller apparatus imposed by the rapidly rotating lobes on the cam. Insufficient time is allowed for any significant bleed off of oil from under the piston, resulting in increased valve opening at high RPM.

What is claimed as new is:

1. In combination with an internal combustion engine having an intake valve train and an exhaust valve train, the improvement comprising:

a. a set of variable duration valve lifters installed in the exhaust valve train; and b. a set of valve lifters installed in the intake valve train having response parameters different from said exhaust train valve lifters, wherein the valve lifters in the exhaust valve train have a relatively larger bleed channel, enabling a variable duration effect of increased valve opening to progressively occur through mid range R.P.M. engine speeds of about 3,000 RPM as RPM increases.

2. The engine of claim 1, wherein said set of valve lifters in the intake valve train are variable duration valve lifters having a relatively smaller bleed channel than said lifters of the exhaust valve train.

3. The engine of claim 2, wherein said intake valve lifters have a relatively smaller magnitude of bleed channel on the order of 0.0025".

4. The engine of claim 1, wherein said intake valve lifters are of invariable duration.

5. The engine of claim 4, where said exhaust valve lifters have a 0.003" bleed channel.

6. The engine of claim 3, wherein said exhaust valve lifters have a bleed channel on the order of 0.003".

7. The process of installing in and operating an internal combustion engine having an intake valve train and an exhaust valve train comprising the steps of:

a. installing and operating a set of variable duration valve lifters in the exhaust valve train; and b. installing and operating a set of valve lifters in the intake valve train having built in response parameters different from said exhaust train valve lifters, wherein the valve lifters in the exhaust valve train have a bleed-down sufficient to allow a variable duration effect of exhaust valve opening to last through mid range RPM speeds of about 3,000 RPM and exhaust valve opening advances as speed advances.

8. The process of claim 7, wherein said set of valve lifters in the intake valve train are variable duration valve lifters having a relatively smaller bleed channel than said lifters of the exhaust valve train.

9. The process of claim 8, wherein said exhaust valve lifters have a relatively larger bleed channel of approximately 0.003" and said intake valve lifters have a relatively smaller bleed channel of approximately 0.0025".

10. The process of claim 7, wherein said intake valve lifters are of invariable duration.

11. The process of claim 10, wherein said exhaust valve lifters have a bleed channel on the order of 0.003".

12. The process of claim 7, wherein said intake valve lifters are variable duration valve lifters with bleed channels smaller than the bleed channels of said exhaust variable duration valve lifters, said intake valve lifter bleed channels being approximately 0.0025".

* * * * *